US006224491B1

(12) United States Patent
Hiromi et al.

(10) Patent No.: US 6,224,491 B1
(45) Date of Patent: May 1, 2001

(54) RIDE-TYPE GAME MACHINE

(75) Inventors: Keisuke Hiromi; Tatsuya Kono; Riichiro Toyama, all of Tokyo (JP)

(73) Assignee: Kabushiki Kaisha Sega Enterprises, Tokyo (JP)

( * ) Notice: Subject to any disclaimer, the term of this patent is extended or adjusted under 35 U.S.C. 154(b) by 0 days.

(21) Appl. No.: 09/011,139

(22) PCT Filed: Jun. 27, 1997

(86) PCT No.: PCT/JP97/02239

§ 371 Date: Mar. 4, 1998

§ 102(e) Date: Mar. 4, 1998

(87) PCT Pub. No.: WO98/00213

PCT Pub. Date: Jan. 8, 1998

(30) Foreign Application Priority Data

Jun. 28, 1996 (JP) ..... 8-169721

(51) Int. Cl.[7] ..... A63O 31/00

(52) U.S. Cl. ..... 472/59; 472/60; 297/180.1

(58) Field of Search ..... 472/59, 60, 61, 472/130; 297/180.1, 180.12, 180.13, 180.14, 180.15, 180.16, 291.1, 297.3, 297.4, 297.5, 297.6; 434/28, 55, 56

(56) References Cited

U.S. PATENT DOCUMENTS

| | | | | |
|---|---|---|---|---|
| 1,789,680 | * | 1/1931 | Gwinnett | 472/60 |
| 3,628,829 | * | 12/1971 | Hellig | 297/217 |
| 4,461,470 | | 7/1984 | Astroth et al. | 272/17 |
| 4,584,896 | * | 4/1986 | Letovsky | 434/55 X |
| 5,695,406 | * | 12/1997 | Park | 472/61 |
| 5,807,177 | * | 9/1998 | Takemoto et al. | 463/47 |

FOREIGN PATENT DOCUMENTS

| | | |
|---|---|---|
| 61-48786 | 4/1986 | (JP) . |
| 63-32588 | 3/1988 | (JP) . |
| 4-352982 | 12/1992 | (JP) . |
| 5-31254 | 2/1993 | (JP) . |
| 7-68054 | 3/1995 | (JP) . |
| 3029006 | 9/1996 | (JP) . |

* cited by examiner

*Primary Examiner*—Kien T. Nguyen
(74) *Attorney, Agent, or Firm*—Finnegan, Henderson, Farabow, Garrett & Dunner, L.L.P.

(57) ABSTRACT

Provides a ride-type game machine which can provide special stimuli individually to a plurality of players. A game machine 1 designed to be ridden by a player, comprising a posture immobilization device 105 for immobilizing the posture of the player, and a medium-discharging device 109 or the like for discharging a prescribed medium (mist spray or the like) onto a specific bodily region (cheek or the like) of the immobilized player. The posture immobilization device 105 presses against the player's body, preventing the player's head from moving. Thus, the medium can be reliably directed onto a specific bodily region of the player, effectively scaring the player.

39 Claims, 14 Drawing Sheets

RIDE-TYPE GAME MACHINE

DESCRIPTION

1. Technical Field

The present invention relates to a game system having a design wherein the player mounts a vehicle to play the game. In particular, it provides a novel game system which provides special stimuli to an individual player, causing the player to become excited.

2. Background Art

Two types of amusement facilities, termed "attractions" can be found at theme parks, amusement shows, and the like. One type is similar to the traditional haunted house; as the player walks along a course through a pre-established facility, the player is frightened by noises, projected images, and effigies. In the other type, the player rides through the facility in a vehicle, boat, or other conveyance; as the conveyance moves about in accordance with the game program, various projected images and sounds are provided to frighten the player. In the past, the attraction format used for a particular amusement facility was selected in accordance with the theme of the game offered by the facility.

In attractions in which the player rides in a conveyance, sound equipment, image projection equipment, and effigies are disposed along the course traveled by the conveyance. The purpose of the sound equipment and the like is to provide stimulation the player and arouse excitement.

However, attractions of the type in which the player rides in a conveyance merely provide visual or auditory stimuli, mainly through the use of projected images, sounds, and the like, and do not stimulate the player's other senses, such as the tactile sense. It would be more effective to provide a player with sensations besides auditory and visual ones. For example, in a game with a monster attack scenario, by realizing a scenario in which the player sitting next to one is attacked by a monster, and the stream of blood spurting from him or her splatters over the player's face, the realism of the game could be significantly enhanced.

If the plot development in this type of scenario was such that "players in the conveyance are attacked by a monster in serial fashion," the sense of terror induced in the players could be maximized. Specifically, when a player hears the screams of horror of players riding in the conveyance traveling in front or sitting next to him or her, the player experiences an even more heightened feeling of tension towards the stimuli awaiting him or her. This feeling of tension enhances the effectiveness of subsequent stimuli on the player.

SUMMARY OF THE INVENTION

Accordingly, it is an object of the present invention to excite the player by providing special stimuli which act upon the tactile sense of the player.

Specifically, the first object of the present invention is to provide a game machine for delivering special stimuli which act upon the tactile sense of the player by discharging a medium onto the player.

The second object of the present invention is to provide a game machine for delivering special stimuli which act upon the tactile sense of the player by blowing air onto the player.

The third object of the present invention is to provide a game machine for delivering special stimuli which act upon the tactile sense of the player by subjecting the player to vibration.

The fourth object of the present invention is to provide a game machine capable of delivering special stimuli individually to each of a plurality of players.

The fifth object of the present invention is to provide a game machine for delivering sounds individually to adjacent players without these sounds interfering with each other.

The game machine which pertains to the present invention is designed to be ridden by a player. The player riding the game machine is immobilized in a certain posture through a posture immobilization device. For example, where the game machine is designed such that the player rides while seated in a seat, the posture immobilization device is favorably one which applies pressure to the upper waist and abdomen of the player in seated posture, pushing the player into the seat. By pushing the abdomen into the seat, the player is prevented from freely moving his or her upper body and head. Specifically, the range of motion of the head, etc., is restricted. Immobilizing the player in a particular posture and preventing him or her from freely shifting position allows stimuli to be delivered individually to different players.

The game machine which achieves the first object of the present invention is provided with a medium-discharging device for discharging a prescribed medium onto a specific bodily region of a player whose posture has been immobilized.

Where such a posture immobilization device is used, a specific bodily region of the player (where the head is immobilized, as in the example described above, the player's cheek or the like) is immobilized, thereby reducing the size of the target range for the medium (water, for example) which is discharged by the medium-discharging device. The player is suddenly squirted with water during game play, and given quite a shock thereby. Besides water, the discharged medium directed into contact with the player can be mist, smoke, light, or a solid.

The game machine which achieves the second object of the present invention is provided with forced air devices capable of blowing air onto the player. The provision of forced air devices capable of blowing air onto a prescribed bodily region of the player allows air to be blown effectively onto a prescribed bodily region of the player (the nape of the neck, for example). The player can be given the impression of wind by the air.

The game machine which achieves the third object of the present invention is provided with a vibration delivery device for subjecting the player to vibration as the game proceeds. In addition, the posture immobilization device immobilizes a part of the player's body against a portion of the vibration delivery device. In one example, by pushing on the seated player's abdomen, the posture immobilization device pushes the player's back against a backrest which comprises the vibrating component of the vibration delivery device. Thus, the vibration delivered by the vibration delivery device is effectively transmitted to the player.

The game machine which achieves the fourth object of the present invention is provided with sound devices for delivering sound to the player in noncontact fashion, and the posture immobilization device immobilizes a part of the player's upper body. Thus, by limiting the possible range of motion of the player's head by means of the posture immobilization device, sound can be delivered to the player in noncontact fashion by means of sound devices disposed around the head of the player. Since the possible range of motion of the player's head is restricted, the localization of the sound delivered to the player does not change even though the sound devices and the player are not in contact. This eliminates the health problems and safety concerns associated with headphones and other sound equipment.

In the aforementioned game machine which achieves the fourth object of the present invention, the medium-discharging devices are disposed such that the discharge port, through which the medium is directed onto a prescribed bodily region of a player, is oriented such that the medium is discharged in a direction other than the direction in which other players are sitting. Accordingly, when the medium is discharged onto one player, it is not directed onto the other players.

In the game machine which achieves the fifth object of the present invention, the phase of the sound waves which constitute the sounds is adjusted such that the phase of the sound waves produced by the sound device which delivers sound to the one of the players at the location of the player's head is substantially the reverse of the phase of the sound waves coming from the sound devices which deliver sound to the other players. Specifically, where sound devices are provided for a plurality of players, some of the sounds coming from one player's sound device can distract other players. In accordance with the present invention, the sound waves of the sounds provided to the other players are canceled, so the player hears only those sounds specifically delivered to him or her.

Particularly in the case of a game machine in which players ride in pairs, the game can be conducted more effectively by disposing the sound broadcasting elements of the sound device in symmetrical fashion. Specifically, in a game where another player is attacked by a monster, a player can be given the vivid impression that the neighboring player is being attacked by broadcasting sounds of attack (growls and so on) from the first player's sound device. By disposing the sound broadcasting elements of the sound device such that the sound images comprised of sounds delivered by the sound devices of the players are symmetrical to each other, each player can be given the impression that the neighboring player is being attacked.

Where a plurality of game machines are to be operated simultaneously, it is favorable to adjust the sound devices of the game machines such that the soundtrack is broadcast simultaneously at equivalent time intervals by all of them.

In the case of a game machine in which players ride in pairs, it is more effective to dispose the medium-discharging devices in symmetrical fashion. For example, in a scene where players are eaten by a monster, by broadcasting the sound of one player being attacked by the monster and spraying the face of the other player with a medium, this other player may be given the impression that the player next to him or her is being attacked and eaten by a monster, and that a stream of blood from the adjacent player who is being attacked is raining down on this other player. By arranging the direction of medium discharge in symmetrical fashion for the two players, each player may be given the impression that the neighboring player is being attacked.

BEST MODE FOR CARRYING OUT THE INVENTION

The best mode for carrying out the invention will be described with reference to the drawings.

(Constitution)

Figure 1:
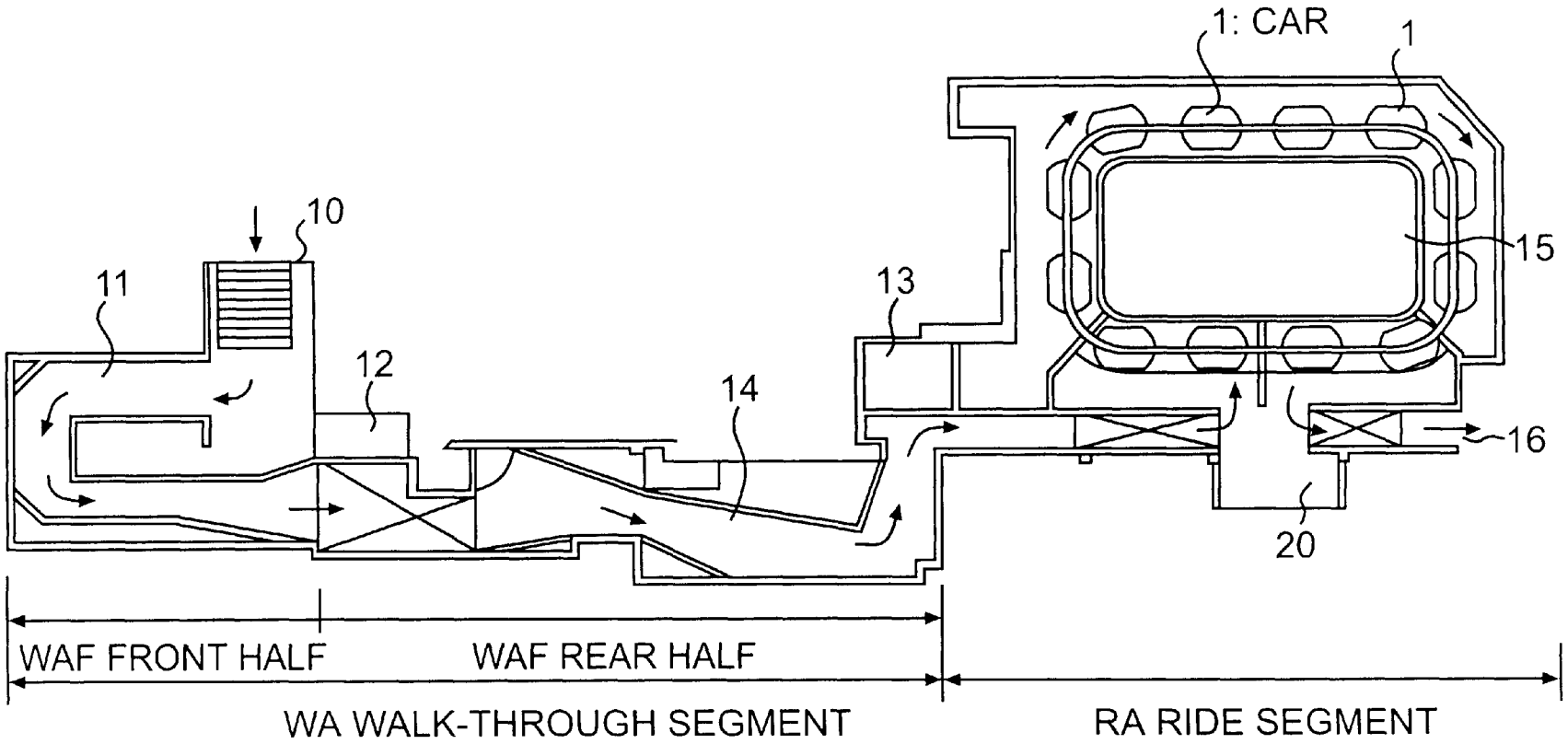
FIG. 1 is an overview diagram depicting the game system in an embodiment of the present invention.

FIG. 1 is an overview diagram depicting the game system in an embodiment of the present invention. As shown in FIG. 1, the game system comprises a walk-through segment WA and a ride segment RA. The walk-through segment WA comprises a front half WAF and a rear half WAR. The lighting is low throughout the entire walk-through segment WA. The walls are done in black in order to produce a sense of unease in the players walking through the passageway, creating a sense of dread that something is going to happen.

Figure 2:
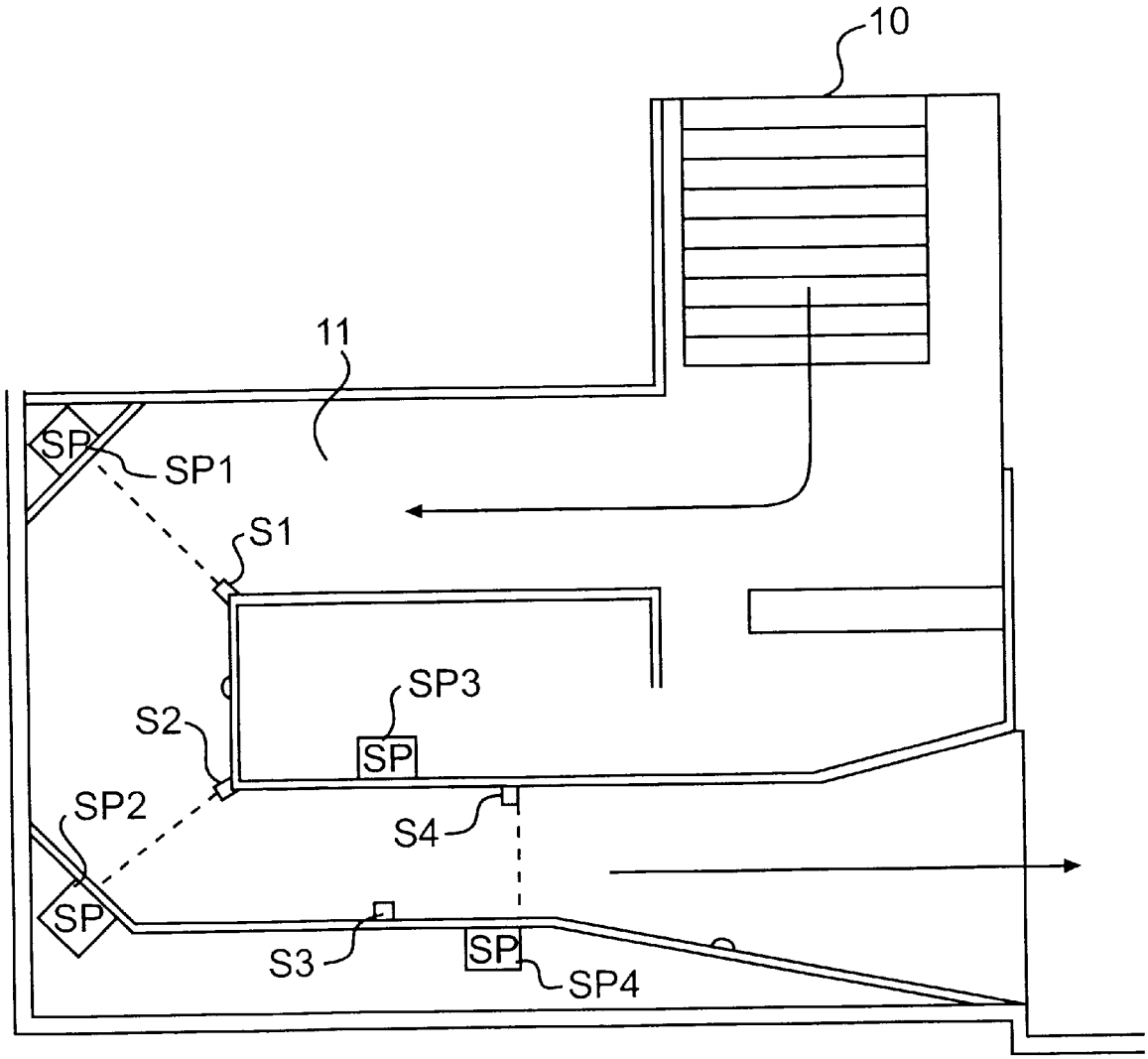
FIG. 2 is an illustrative diagram of the front half of the walk-through segment.

The front half WAF is provided with an entrance 10 and a passageway 11. The walls of the passageway are equipped with sensors S1 through S4 and speakers SP1 through SP4, as shown in FIG. 2.

Figure 5:
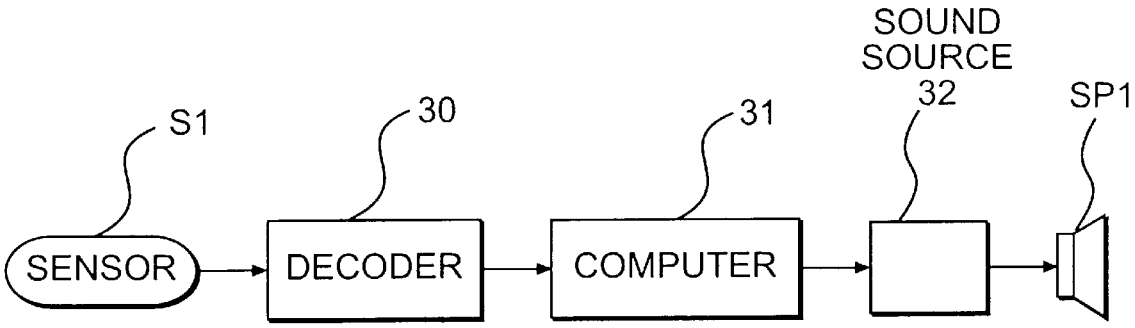
FIG. 5 is a block diagram of a sound device.

A decoder 30, a computer 31, and a sound source 32 are connected between the sensor S1 and the speaker SP1, as shown in FIG. 5. The other sensors and speakers are connected in the same fashion.

The sensor S1 is designed to output a sensor signal when a person passes in front of it or approaches it. An infrared sensor is one example; any other type of sensor capable of sensing the approach of a player may be used as well. The decoder 20 is designed to decode the sensor signal from the sensor S1 and output an interrupt signal to the computer. The computer 31 is designed to issue sound source control signals on the basis of interrupt signals from the decoder 20 so that these can be delivered to the sound source device 32. The sound source device 22 is designed to receive the sound source control signals and output corresponding sound signals. The sounds produced by means of this design correspond to the theme of the game in which players subsequently participate in the ride segment RA. For example, where the theme of the game is "exploring the world of monsters," sounds mimicking the howls of monsters can be provided.

The rear half WAR is provided with a first projection device 12, a passageway 14, and a second projection device 13.

Figure 3:
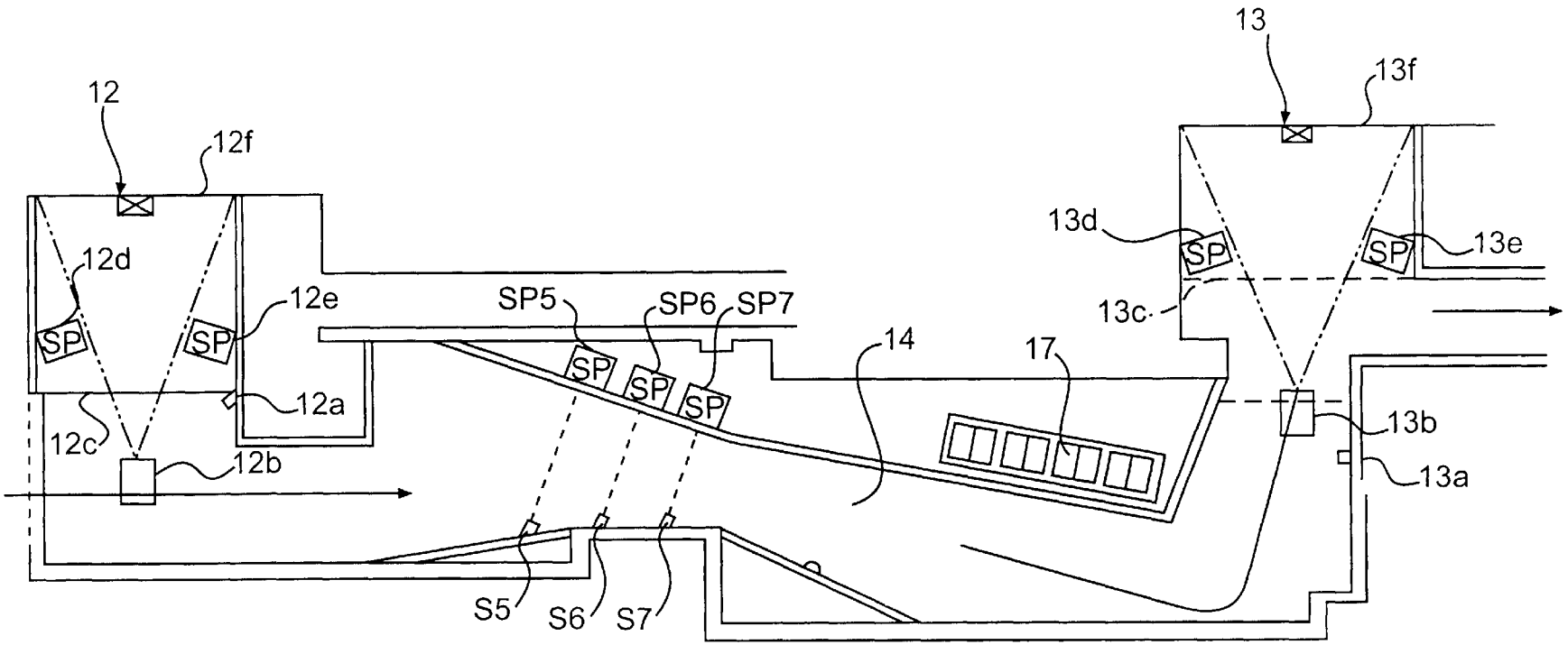
FIG. 3 is an illustrative diagram of the rear half of the walk-through segment.

As shown in FIG. 3, the first projection device 12 is provided with a sensor 12*a*, a projector device 12*b*, a fence 12*c*, speakers 12*d* and 12*e*, and a screen 12*f*. 13*a* through 13*f* of the second projection device 13 have the same design as the first projection device 12.

Figure 6:
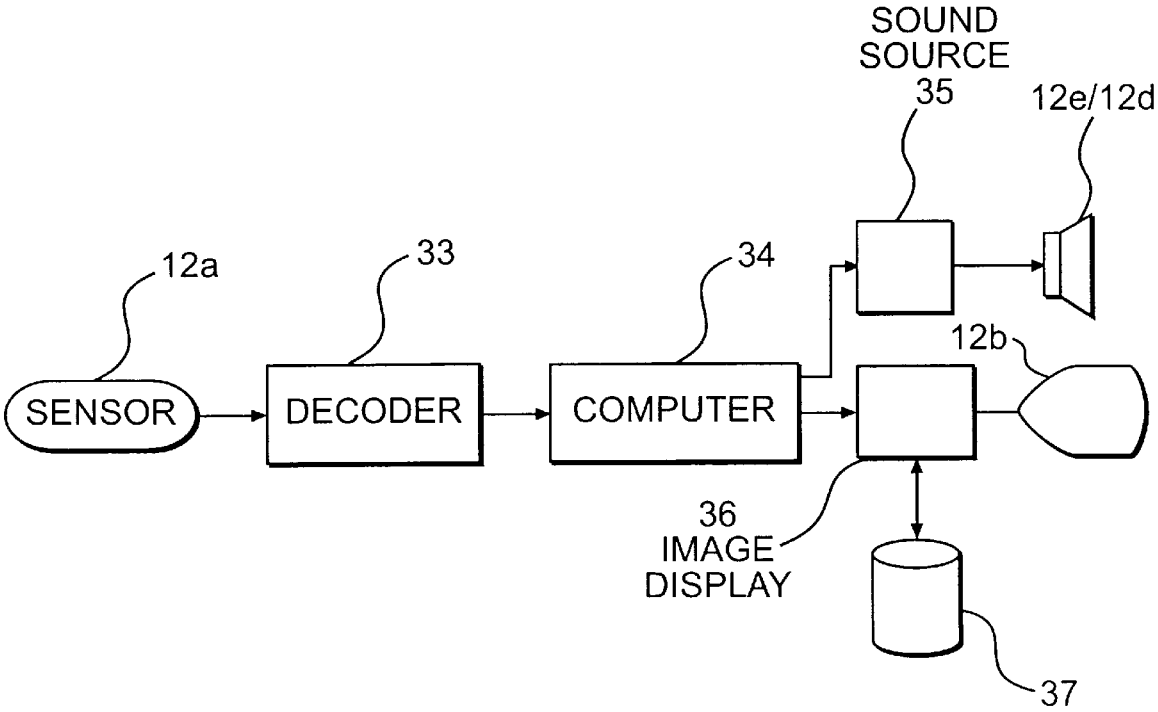
FIG. 6 is a block diagram of a projection device.
Figure 7:
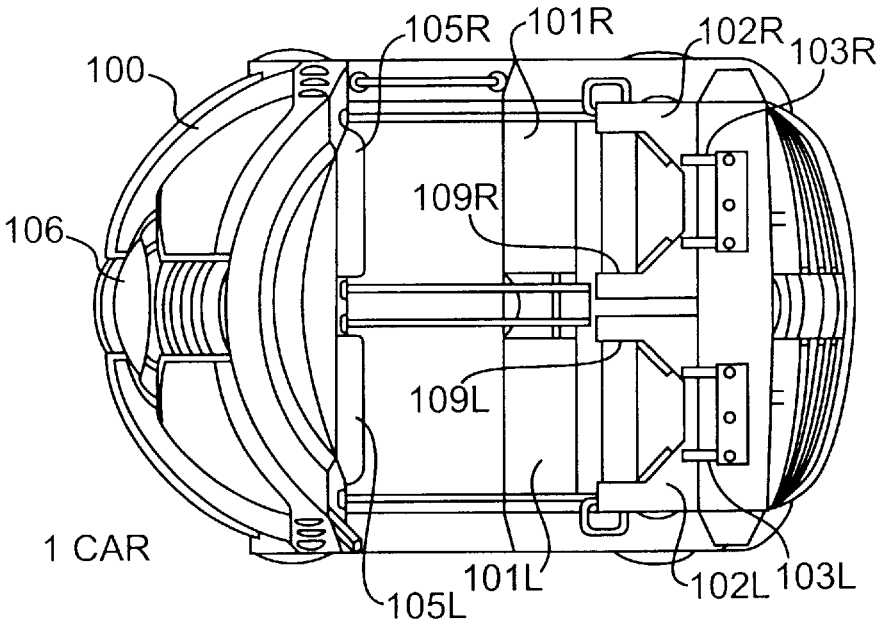
FIG. 7 is a plan view of a car.
Figure 8:
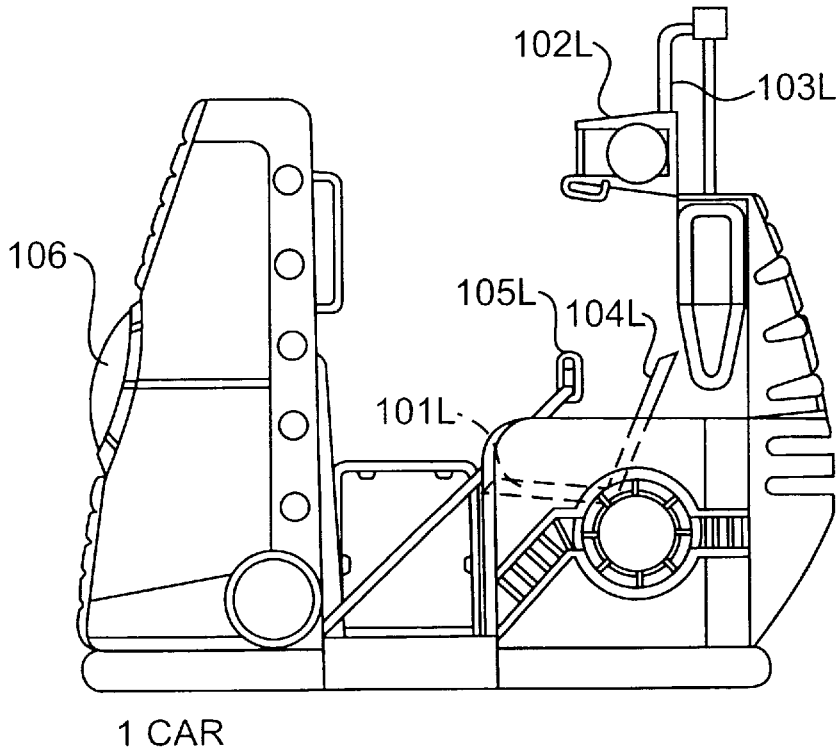
FIG. 8 is a side elevation of a car.
Figure 9:
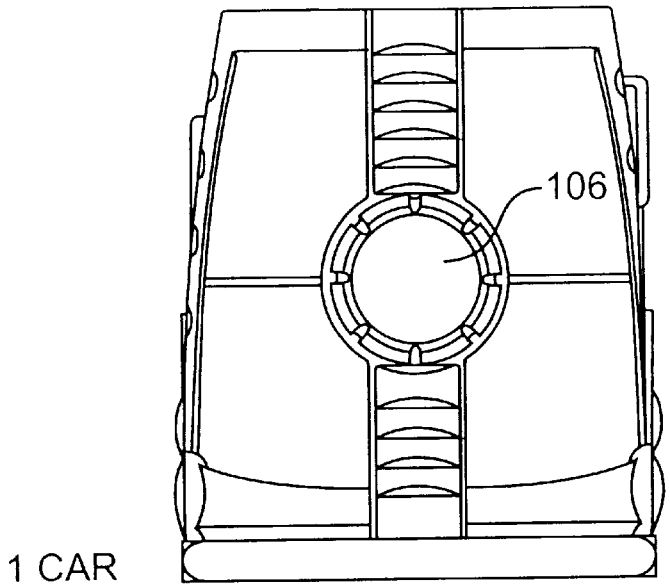
FIG. 9 is a front elevation of a car.
Figure 10:
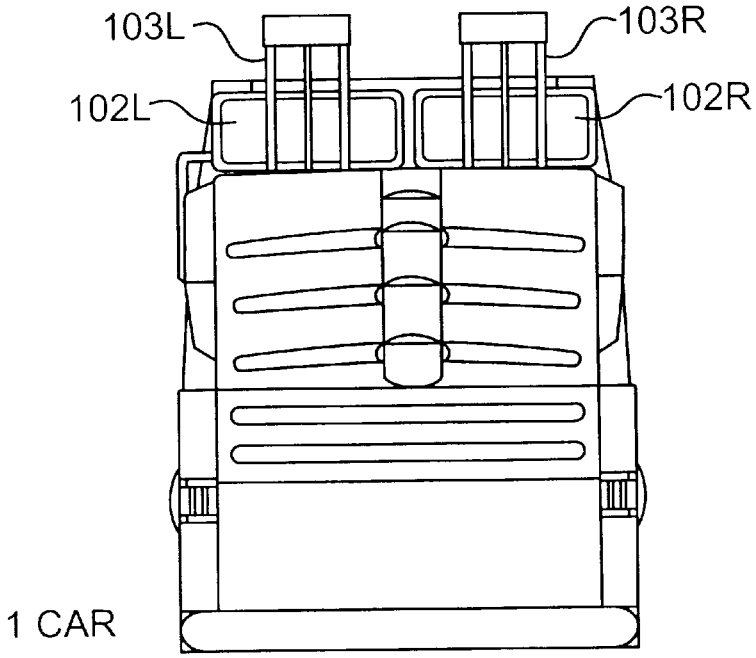
FIG. 10 is a rear elevation of a car.

As shown in FIG. 6, the first projection device 12 is also provided with decoder 33, a computer 34, a sound source circuit 35, an image display circuit 36, and a memory 37.

The decoder 33 is designed such that sensor signals from the sensor 12*a* are converted into digital signals which can be input to the computer. The computer 34 is designed such that, on the basis of the sensor signals which have been converted into digital signals, sound source control signals may be delivered to the sound source circuit 35 and image display commands may be delivered to the image display circuit 36. The sound source circuit 35 is designed to generate sound signals for broadcast from the speaker 12*e* or 12*d* on the basis of the sound source control signals. The image display circuit 36 is designed to project image signals on the basis of image data stored in the memory 37 from the projector device 12*b*. The images and sounds produced in this design relate to the theme of game play. For example, where the theme of game play is "exploring the world of dinosaurs," images of flying monsters and sounds mimicking the howls of monsters can be provided.

As shown in FIG. 3, the walls of the passageway 14 are provided with sensors S5 through S7, speakers SP5 through SP7, and a monitor 17. The configuration in which the sensors and speakers are connected is the same as that depicted in FIG. 5. The monitor 17 is designed to display visually information useful to players and precautions to be observed when riding the car 1 in the ride segment RA.

Figure 4:
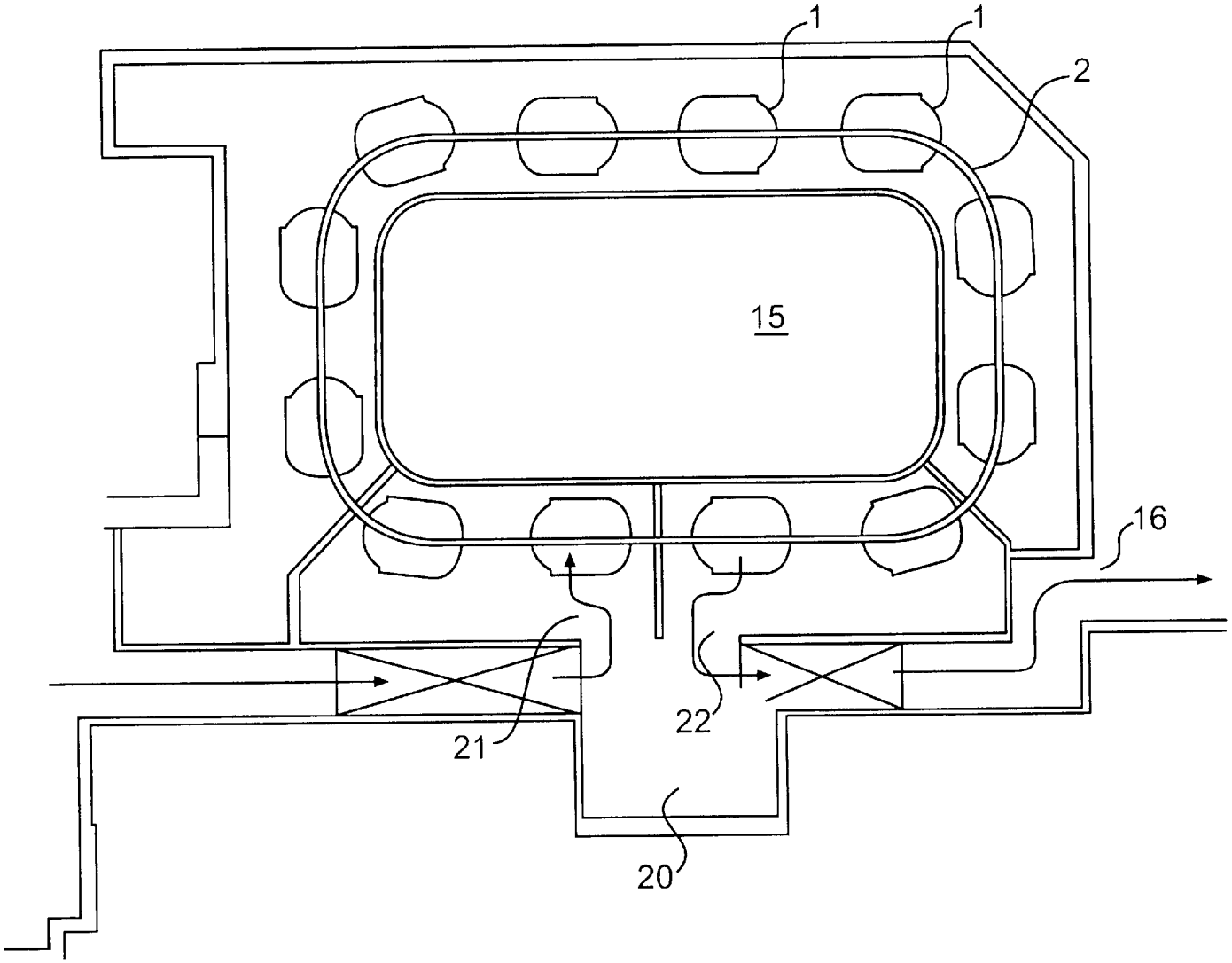
FIG. 4 is an illustrative diagram of the ride segment.

As shown in FIG. 4, the ride segment RA is provided with a platform area 20, a boarding area 21, a circle 15, a deboarding area 22, and an exit 16.

The ride entrance 21 is designed to allow players to get into the cars 1. The circle 15 comprises a plurality of cars 1 and a track 2. As described later, the plurality of cars 1 are capable of traveling around the track 2 simultaneously under their own power under individual control, or controlled from a control room (not shown). A guide 2 constitutes a closed course several dozen meters in total length, for example. The deboarding area 22 is designed to allow players to alight from the cars 1. The exit 16 is designed to allow players to exit the game system to the outside.

The design of the car 1 which pertains to the present invention will now be described referring to FIGS. 7 through 10. In the drawing symbols, R indicates a component for the right seat and L indicates a component for the left seat.

The design of the car 1 comprises a car body 100 equipped with seats 101R, L, and with slide bars 103R, 103L and headrests 102R, L located behind the seats. The headrests 102R and L can slide along the slide bars 103R and L. The backrests 104R, L of the seats 101R, L are designed such that they can be vibrated by the vibration device described later. Safety bars 105R, L are rotatably disposed to the front of the seats. A light 106 is provided to the front of the car body 100.

Figure 11:
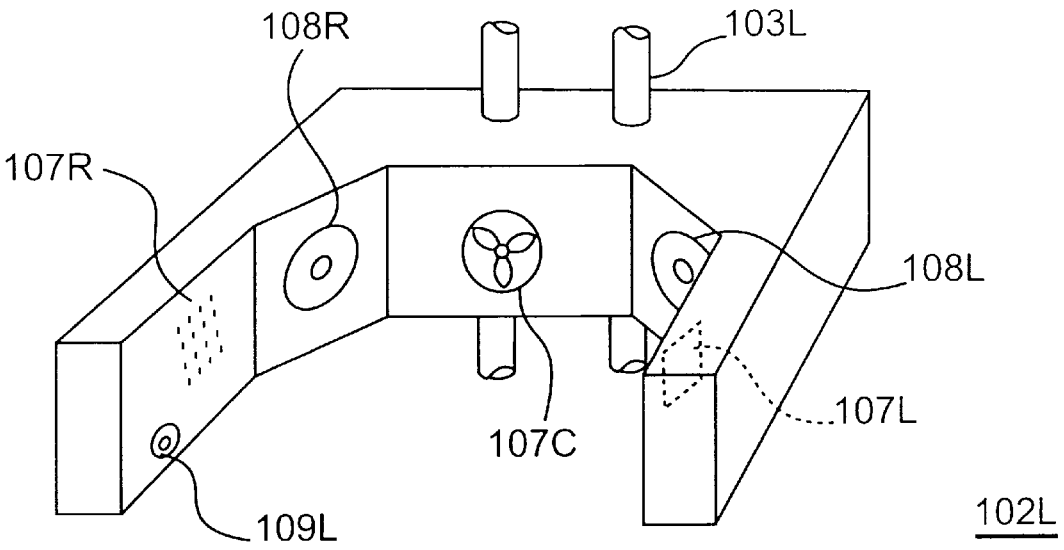
FIG. 11 is a perspective illustration of a headrest.

As shown in FIG. 11, the headrest 102R is provided with fans 107C, 107R, and 107L, with speakers 108R and 108L, and with a discharge port 109L. The headrest 102R has the same design, except for the location of the discharge port 109.

Figure 12:
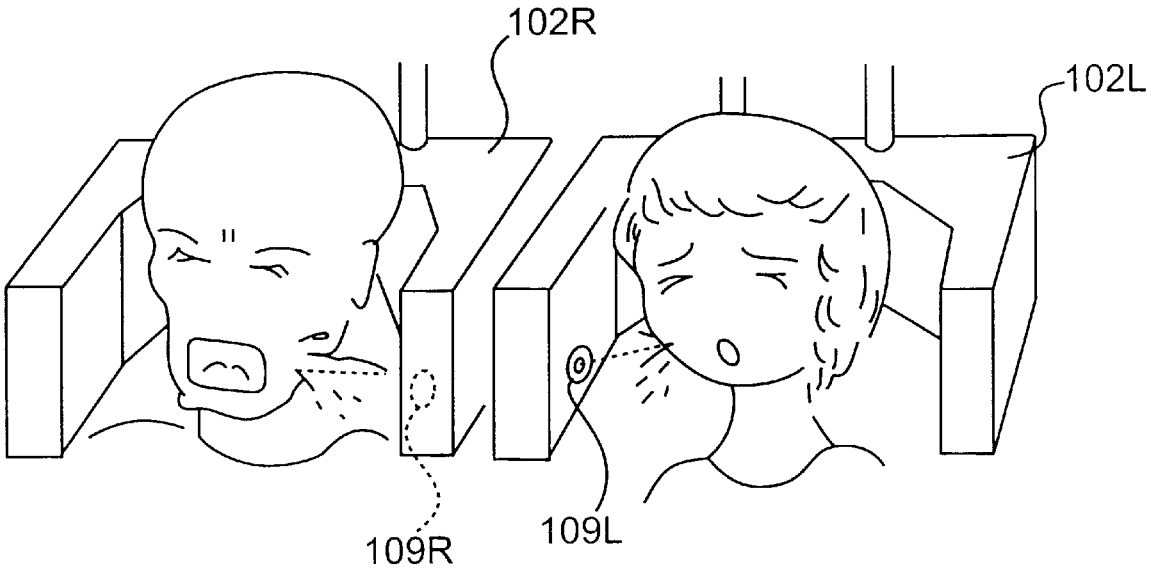
FIG. 12 is an illustrative diagram of headrest installation.

As shown in FIG. 12, the headrests are large enough to accommodate the head of the player within the U-shaped interior of the headrest. The fans 107C, R, and L comprise forced air devices disposed so as to direct air onto the head the player from both sides and the back of the player. The speakers 108R and L constitute one element a sound device which provides stereo sound to the player. The discharge port 109L comprises a nozzle device for spraying mist onto an area of the player's cheek by means of a pump. The discharge ports 109 are disposed in different locations in the right seat and the left seat. Specifically, in the left headrest 102L, the discharge port 109L is oriented towards the inside of the arm on the right side (the player's cheek side). In the right headrest 102R, the discharge port 109R is oriented towards the inside of the arm on the left side. That is, the discharge ports 109R, L in the two headrests are oriented in opposite directions.

Figure 13:
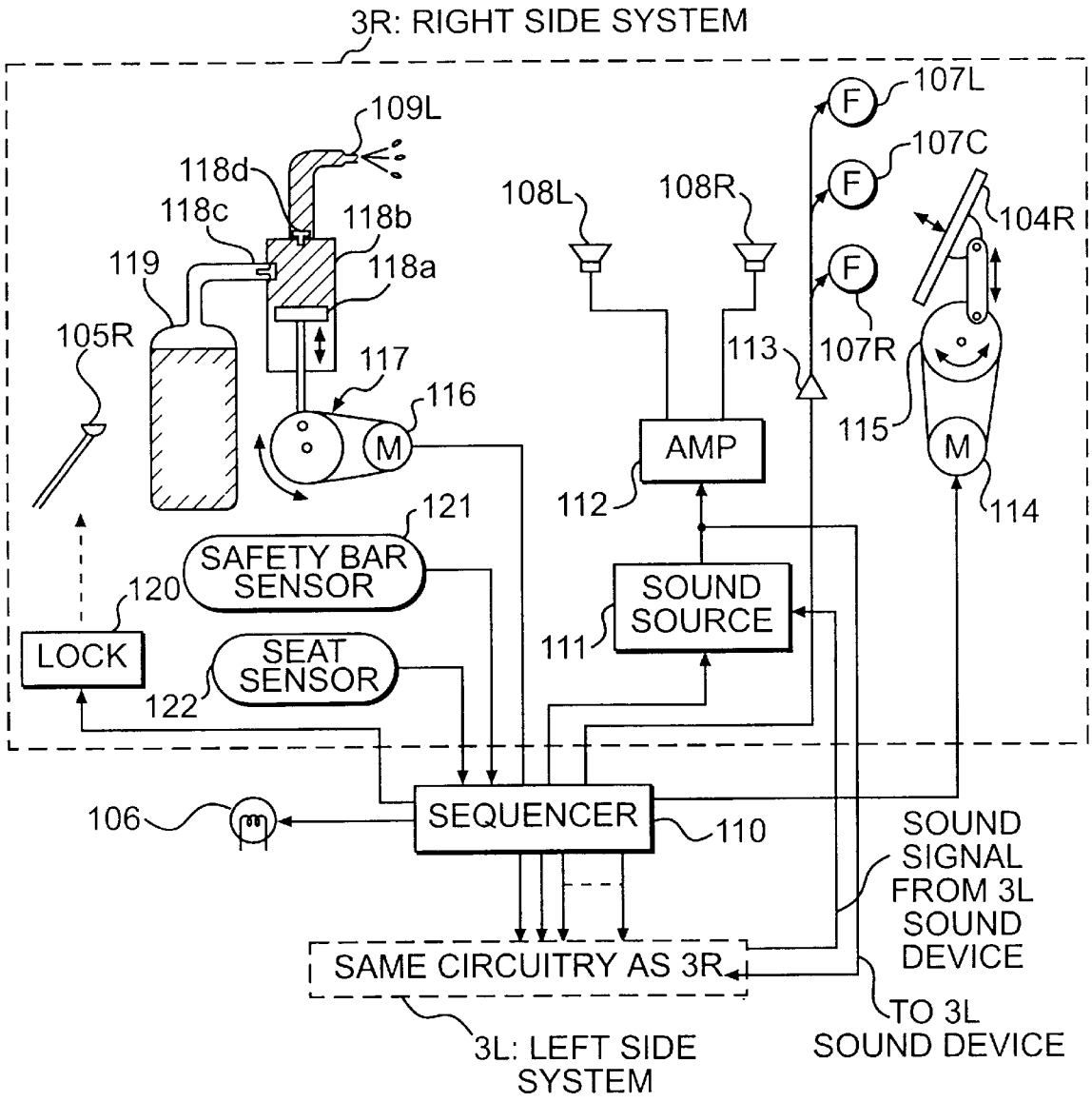
FIG. 13 is a car control block diagram.

As shown in FIG. 13, the design of the control system of the car 1 comprises a sequencer 110, a sound source device 111, an amp 112, a buffer 113, a motor 114, a transmission mechanism 115, a motor 116, a transmission mechanism 117, a piston 118*a*, a cylinder 118*b*, valves 118*c* and 118*d*, a tank 119, a rocking mechanism 120, a safety bar sensor 121, and a seat sensor 122.

The car 1 is provided with a right side system 3R and a left side system 3L for the left and right seats. Since these have identical constitution, only the right side system is described below.

The sequencer 110 comprises a computer unit which can output control signals as indicated in the flow chart (FIG. 14) described below. The sequencer 110 is designed to be capable of controlling both the right side system 3R for the right seat and the left side system 3L for the left seat.

The sound source device 111 is designed to be capable of generating sound signals on the basis of sound source control signals output by the sequencer 110. These sound signals are amplified and delivered to the speakers 108R and L.

With this design, sound waves from the other headrest are canceled in proximity to the ears of each player, so that each player perceives only the sound delivered to his or her headrest. This design is particularly effective where the sounds provided to the player on the right side are different than the sounds provided to the player on the left side.

Where a game program involves providing identical sound signals to players seated adjacently, sound output may be designed such that the localization of the sounds provided by the sound source device 111 of the right side system 3R and the localization of the sounds provided by the sound source device 111 of the left side system 3L are reversed left to right. With this design, sounds heard from the left by the player seated on the right side are heard from the right by the player seated on the left side.

Where a game program involves providing different sounds to players seated adjacently, and sounds from an adjacent player's side would impair game play, the sound source device 111 is designed to receive sound signals from the sound source device of the left side system 3L, while at the same time the signals of this sound source device 111 of the right side system 3R are output to the sound source device of the left side system 3L. This sound source device 111 is also designed such that sound signals delivered from the left side system can be synthesized with the sound signals of this sound output device 111 of the right side system 3R for output. Specifically, the phase of the sound signals from the left side system 3L is adjusted such that the phase of the sound waves coming from the left side headrest 102L and the phase of the sound waves generated by this sound source device 111 on the basis of sound signals from the left side system 3L diverge by 180° in proximity to the ears of the player wearing the headrest 102R. Additionally, the amplification of the sound signals from the left side system 3L is adjusted such that the amplitude of the sound waves coming from the left side headrest 102L and the amplitude of the sound waves generated by the sound source device 111 on the basis of sound signals from the left side system 3L have identical amplitude values in proximity to the ears of the player wearing the headrest 102R. With this design, sound coming from an adjacent player's side can be canceled.

The buffer 113 is designed to amplify the fan instruction signals output by the sequencer 110 and deliver these to the fans 107*a* through *c*. Fan instruction signals may be delivered simultaneously to all three fans, or delivered at different times to individual fans.

The motor 114 and the transmission mechanism 115 comprise a vibration device capable of transmitting vibration to the backrest 104. The motor 114 is designed to rotate on the basis of vibration instruction signals output by the sequencer 110; the transmission mechanism 115 is designed to convert the rotary motion of the motor 114 into reciprocating motion.

The motor 116, transmission mechanism 117, piston 118*a*, cylinder 118*b*, and tank 119 together comprise a medium-discharge (pump) device for discharging the medium from the discharge port 109. The motor 116 is designed to rotate on the basis of pump instruction signals output by the sequencer 110; the transmission mechanism 117 is designed to convert the rotary motion of the motor 116 into reciprocating motion. The piston 118*a* moves in accordance with this motion; when the piston 118*a* descends (during inspiration) due to motion of the transmission mechanism 117, the valve 118*c* opens and the valve 118*d* closes.

In accordance with this medium-discharge layer device, a prescribed quantity of the medium contained in the tank 119 (here, water) is drawn into the cylinder 118*b*. When subsequent operation of the transmission mechanism 117 induces the piston 118*a* to rise (during ejection), the valve 118*c* closes and the valve 118*d* opens. As a result, the water within the piston 118*b* is discharged through the discharge port 109. Since the discharge port 109 takes the form of a nozzle, the discharged water forms a mist.

A lock mechanism 120 is designed so as to lock the headrest 102 and the safety bar 105 on the basis of a lock signal from the sequencer 110. The lock can be an electromagnetic lock or other means.

The safety bar sensor 121 is designed to put the lock signal delivered to the sequencer 110 in the "on" state (a logical "1", for example) when the safety bar 105 is locked, and to put the lock signal in the "off" state (a logical "0", for example) when unlocked.

The seat sensor 122 is designed to detect whether the player is sitting correctly in these at 101. When the player is sitting correctly, the sensor signal output to the sequencer 110 is "on", and when not, the sensor signal is "Off". The seat sensor 121 may comprise, for example, a lamp and a photoelectric converter element or the like, designed such that when the player is seated in the seat 101, thereby blocking the light from the lamp, the photoelectric converter element outputs a sensor signal.

The lamp 106 lights on the basis of a light instruction signal 110 from the sequencer 110.

While not shown, the power supply for all the cars 1 and the operation status are monitored from a control room. The control room controls the delivery of the power supply to all of the cars 1, and if an emergency should arise, all cars 1 can be forced to stop immediately.

(Operation)

Walk-through Segment

In the constitution described above, a player enters through the entrance 10 of the walk-through segment WA and passes through the front half WAF. As the player passes through the passageway 11, the sound devices comprising the sensors S1 through S4 and the speakers SP1 through SP4 are activated. Specifically, sounds are emitted as a player approaches the sound devices. The player is startled by the sounds delivered by the four sound devices in the front half WAF, and then proceeds to enter the rear half WAR.

In the rear half WAR, as a player approaches the first projection device 12, the player s approach is sensed by the sensor 12*a*, and image of a monster is displayed on the screen 12*f*, and a howling voice is broadcast from the speaker 12*d*/*e*, startling the player. As the player subsequently passes down the passageway 14, sounds are again produced by the sound devices comprising the sensors S1 through S4 and the speakers SP1 through SP4, further scaring the player. The player subsequently turns a corner in the passageway 14, whereupon the second projection device 13 is activated, again producing the monster's image and howls.

Players, who by this time are thoroughly scared, are guided to the platform 20 of the ride segment RA, from which, in pairs, they board cars 1 through the boarding door 21.

In the ride segment RA, players ride in any of the cars 1 traveling around the circle 15. The cars 1 carrying the players complete one circuit around the circle 15. Having ridden in a car 1 once around the guide 2, the players deboard from the car 1 at the deboarding area 19 and exit to the outside through the exit 16.

(Car Operation)

Figure 14:
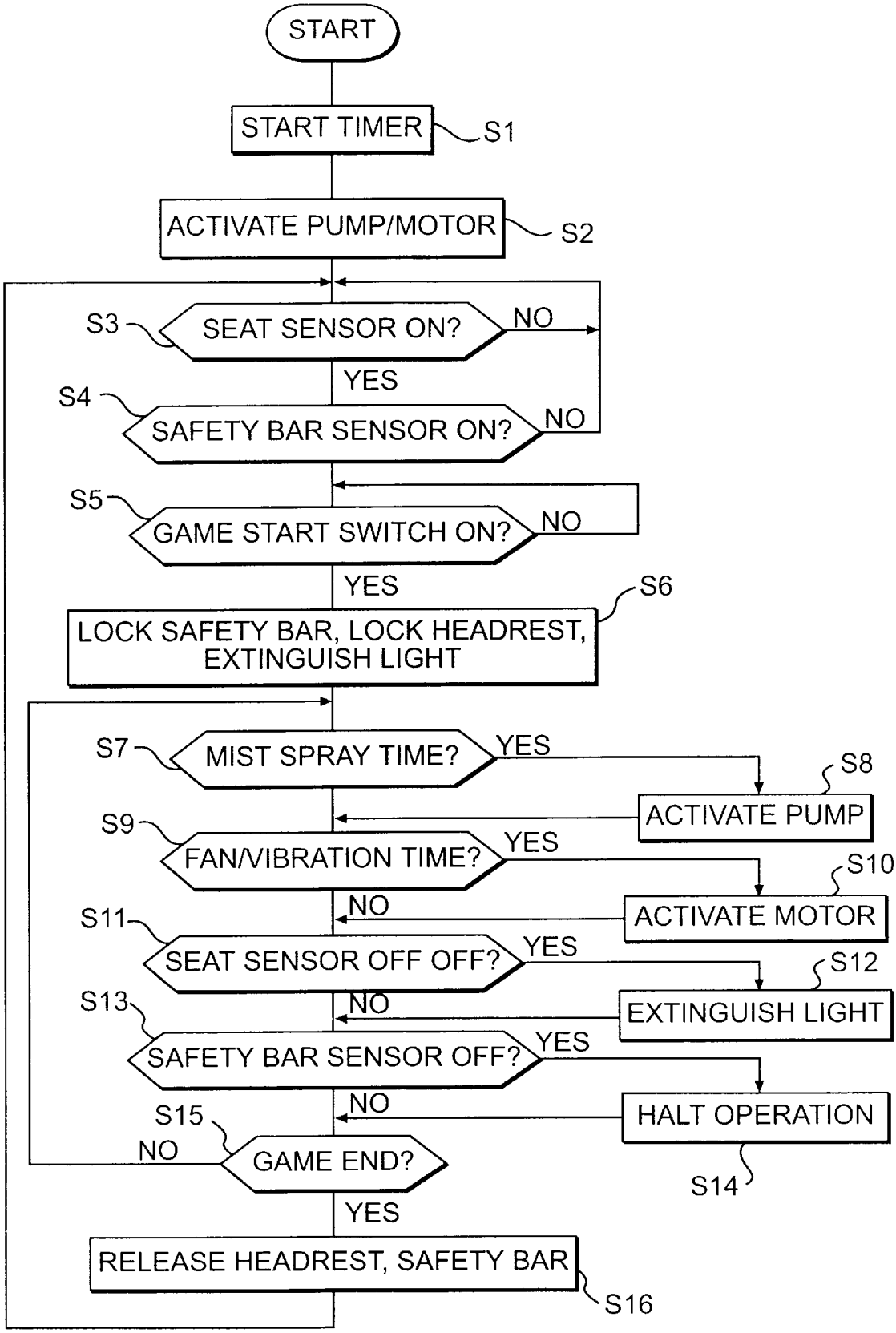
FIG. 14 is a flow chart illustrating operations in an embodiment of the present invention.

Next, the operation of a car 1 will be described referring to the flow chart of FIG. 14.

First, turning on the power supply for the car 1 activates a program timer (S1). The vibration device motor 114 and the pump motor 116 are activated (S2). In steps S3 and S4, a safety check is performed to determine if the players are seated correctly.

Figure 15:
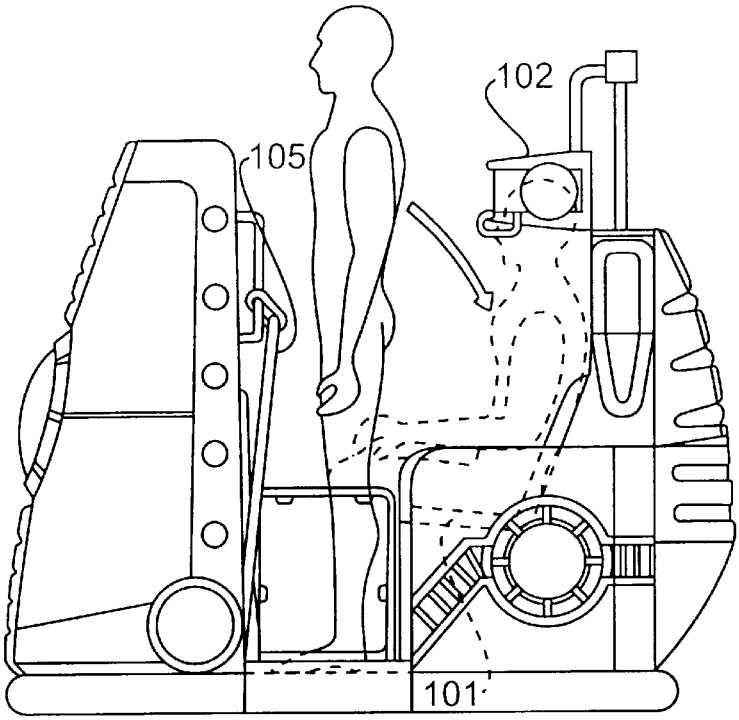
FIG. 15 is a diagram illustrating the car boarding procedure (first step)
Figure 16:
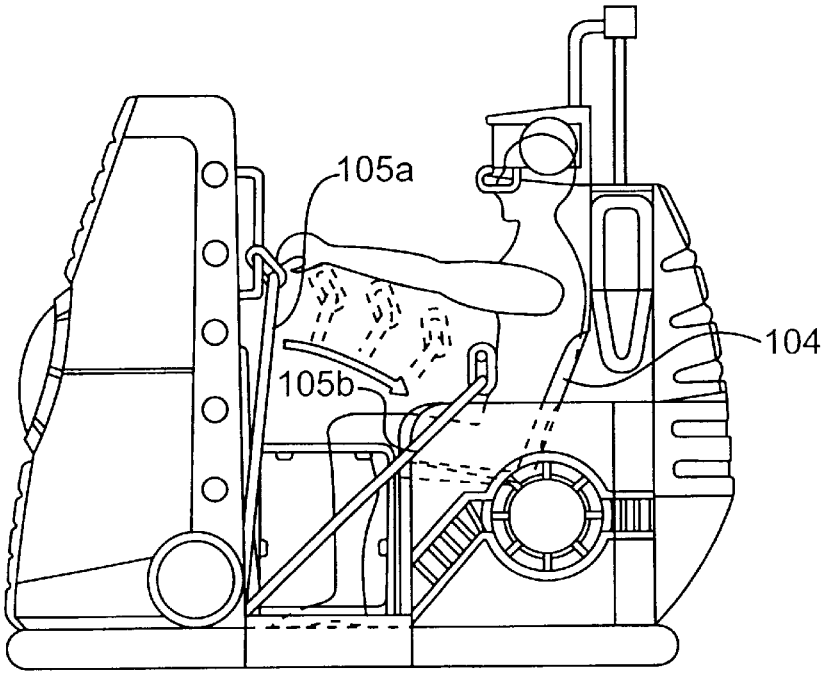
FIG. 16 is a diagram illustrating the car boarding procedure (second step)

The procedure by which players board the car 1 will now be described referring to FIG. 15 through FIG. 18. As shown in FIG. 15, the player first sits in the seat 101. If the player is sitting in seat 101 correctly, the sensor signal from the seat sensor 122 goes to "on". Next, as shown in FIG. 16, the player manually pulls down the safety bar 105 from position 105*a* to position 105*b*. Once the safety bar 105 has been pulled down to the correct position, the safety bar sensor 121 puts the lock signal to "on". The length of the safety bar 105 has been adjusted such that when the bar has been pulled down, the abdomen contact section thereof presses against the player's abdomen. When the safety bar 105 so adjusted is pulled down and locked, the upper body of the player is pressed against the backrest 104 by the abdomen contact section of the safety bar 105. In this position, the person cannot move his or her upper body forward, and cannot move the head to any significant degree. Specifically, as may be determined by looking at FIG. 15, the back support member and pelvic support member of the seat 101 are disposed at an angle to each other, thereby restricting the range of free motion of head, even without the provision of immobilization means for immobilizing the head directly. Accordingly, when the medium is discharged, the medium can be aimed within a limited region of the head. When the head is not allowed to move, significant changes in the relative position of the headrest 102 and the player's head can be prevented. This prevents changes in the localization of the sounds delivered through the headrest 102.

Figure 17:
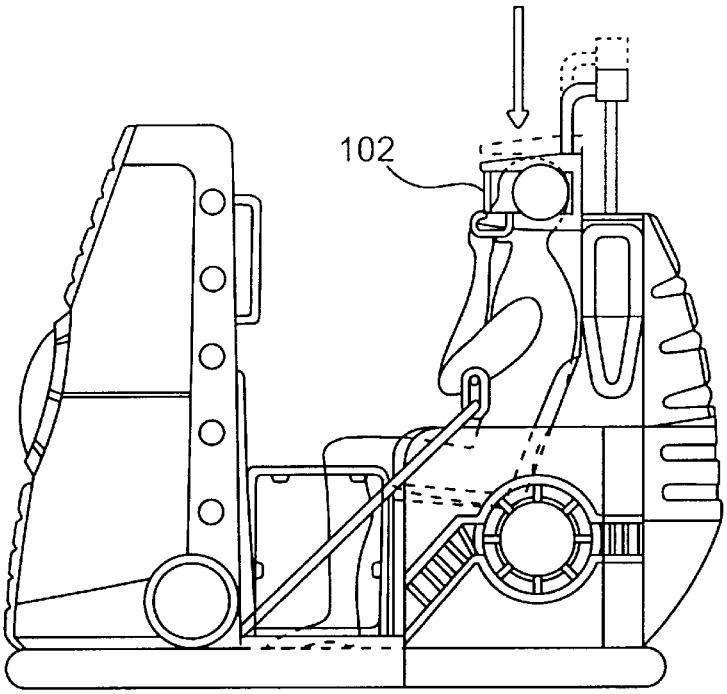
FIG. 17 is a diagram illustrating the car boarding procedure (third step)
Figure 18:
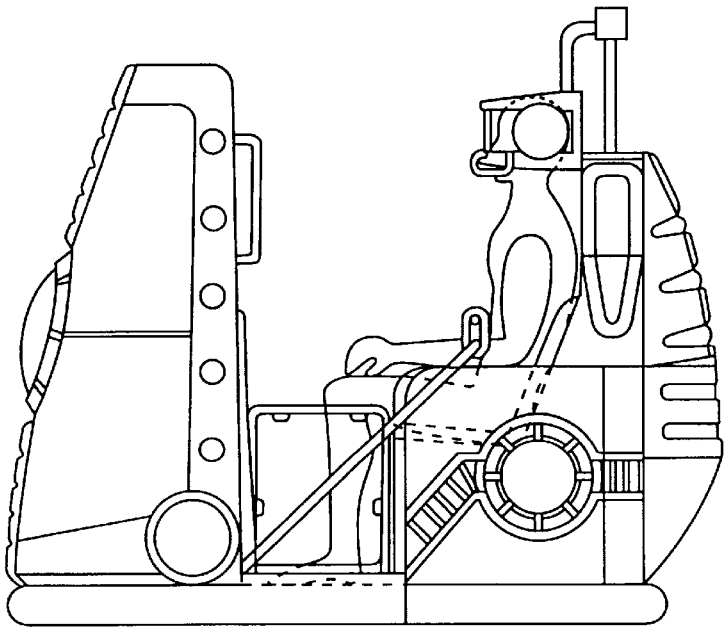
FIG. 18 is a diagram illustrating the car boarding procedure (fourth step)
Figure 19:
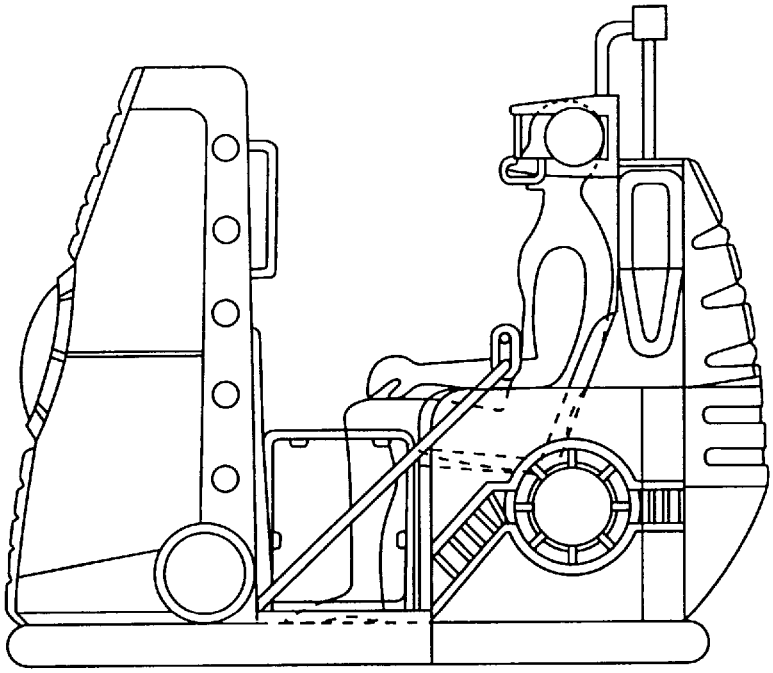
FIG. 19 is a diagram illustrating the car exit procedure (first step)

Once the safety bar 105 has been locked, the player pulls down the headrest to a position such that the U-shaped arms of the headrest 102 surround both ears, as shown in FIG. 17. Once locked, the headrest cannot be moved unless force above a certain level (15 kg to 20 kg) is applied; thus, once the player has moved it into the prescribed position, it cannot fall under its own weight. As shown in FIG. 18, once the player is correctly seated, the safety bar 105 secured, and the headrest 102 pulled down, the sensor output of the seat sensor 122 goes to "on" (S3; YES) and the safety bar sensor 121 lock signal also goes to "on" (S4; YES).

Through instructions given from the control room, or by the player pressing a switch (not shown), a game start command is issued (S5; YES), whereupon the sequencer 110 outputs a lock instruction signal, and the headrest 102 and safety bar 105 are locked by the lock mechanism 120. At the same time, the light 106 is extinguished (S6).

The car 1 then proceeds to move along the guide 2. Each car 1 carrying players moves slowly (several tens of centimeters per second) along the guide 2.

In accordance with the game program, the sequencer 110 monitors the timing at which the devices for scaring the players are activated.

Specifically, when the time for a mist spray is reached (S7; YES), the sequencer 110 activates the pump device. Specifically, a pump instruction signal is output, and mist is sprayed from the discharge port 109. The player receives an unexpected stimulus from this mist spray, and is greatly startled, as depicted in FIG. 12. At this time, the mist discharge from one discharge port 109L (R) sprays one player, but does not get the other player wet, as depicted in FIG. 12. Since the posture immobilization device afforded by the safety bar 102 immobilizes the position of the player's body and does not allow the head to move by any appreciable degree, correct positioning of the headrest allows the mist from the discharge port 109L (R) to be aimed reliably at the cheek of the player.

The effect is enhanced by synchronizing the mist spray with sounds. For example, in the case of a game with a scenario in which an adjacent player is attacked by a monster, sounds of the player to the right being attacked (monster howls and the sound of a human being eaten) are broadcast from the speaker 108R located to the right side of the player on the left who is using the headrest 102L. At the same time, a mist spray is discharged from the discharge port 109R of the headrest 102L. By timing the mist spray to coincide with the sounds broadcast from the speaker 108R, the player on the left side can be given the impression that the player on the right side is being eaten by a monster, and that he or she is hearing the sound thereof and being splattered by a stream of blood.

In accordance with the constitution of the present invention, the player on the right can be provided with a sound localization which is reversed left to right with respect to the sound image of the sounds provided to the player on the left. The headrest 102R used by the player on the right is provided with a sound image localization which is reversed left to right with respect to the localization of the sound image provided to headrest 102L used by the player on the left. Conceived in simple terms, the sound signals provided to the speaker 108R of the headrest 102L are also provided to the speaker 108L of the headrest 102R, and the sound signals provided to the speaker 108L of the headrest 102L are also provided to the speaker 108R of the headrest 102R. With this design, the sounds perceived by the player on the left as coming from the direction of the right side (that is, the adjacent player) are perceived by the player on the right as coming from the direction of the left side (that is, the adjacent player). That is, by providing each of adjacent players with the same sounds, each player can be given the impression that the other is being attacked by a monster. Since the discharge port 109R is provided on the right in the headrest 102L while the discharge port 109L is provided on the left in the headrest 102R, spray is directed onto the player on the left side from his or her right, while spray is directed onto the player on the right from his or her left. Thus, each of adjacent players can be given the impression that the other has been attacked by a monster and that he or she is being sprayed by a stream of blood produced thereby.

Where each of adjacent players is to be provided with different sounds, sounds emanating from the adjacent player's side represents a distraction. Accordingly, it is desirable to deliver the sound to each in such a way that sound waves from the other headrest are canceled in the vicinity of the ears of each player. Each player perceives only those sounds delivered to his or her headrest.

When the correct time for delivering a blast of air or vibration has been reached (S9; YES), the sequencer 110 outputs a vibration instruction signal to the motor 114, or delivers fan instruction signals to the fans 107C, R, and L through the buffer 113. As a result, the player's backrest 104 vibrates, or a blast of air is delivered to the player's head by the fans 107C, R, and L located in the headrest 102, again startling the player. Vibration instructions and fan instructions may be delivered under different timing.

If the player is noted to move out of the correct posture, it is possible that the player is attempting to pick something up or perform some other unusual action. In such an event, the seat sensor 122 sensor signal goes to "off" (S11; YES), and an inside light (not shown) and the light 106 are turned on (S12).

When safety bar sensor 121 lock signal has gone to "off", it is possible that a player has forcibly pulled up the safety bar 105 and has attempted to exit the car or to perform some other unsafe action. Accordingly, when it is sensed that the lock signal is "off" (S13; YES), the sequencer 110 halts the operation (S14). The game system operator, when apprised of the operation shutdown, performs a safety check of the car in which the safety bar 105 has become unlocked.

The aforementioned steps S7 through S14 are repeated for as long as the game has not ended (S15; NO). Once a car 1 has made one circuit along the guide 2 around the circle 15 and reached the deboarding area 19, the game ends (S15; YES). The sequencer 110 then instructs the lock mechanism 120 to release the headrest and the safety bar lock.

Figure 20:
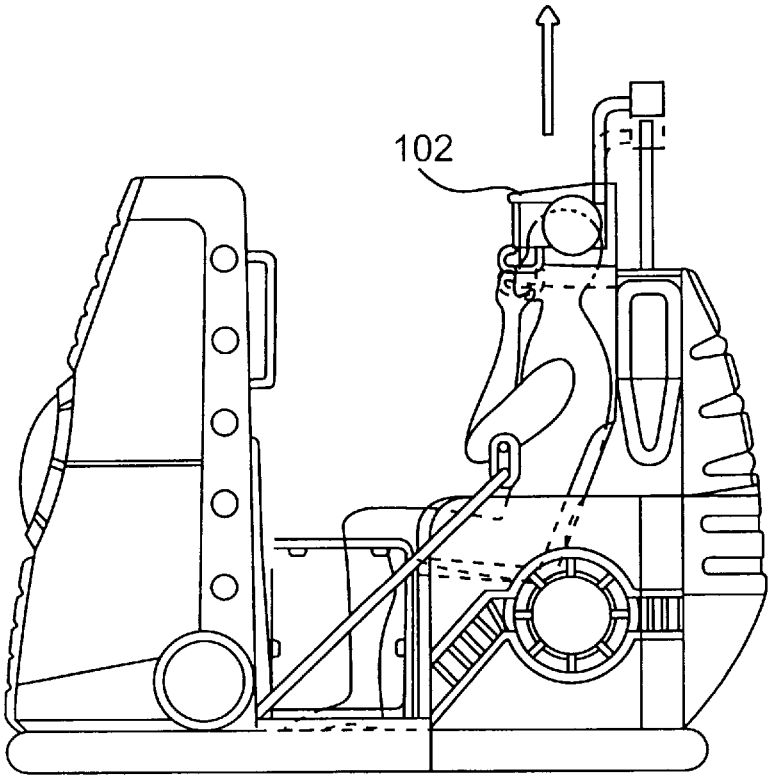
FIG. 20 is a diagram illustrating the car exit procedure (second step)
Figure 21:
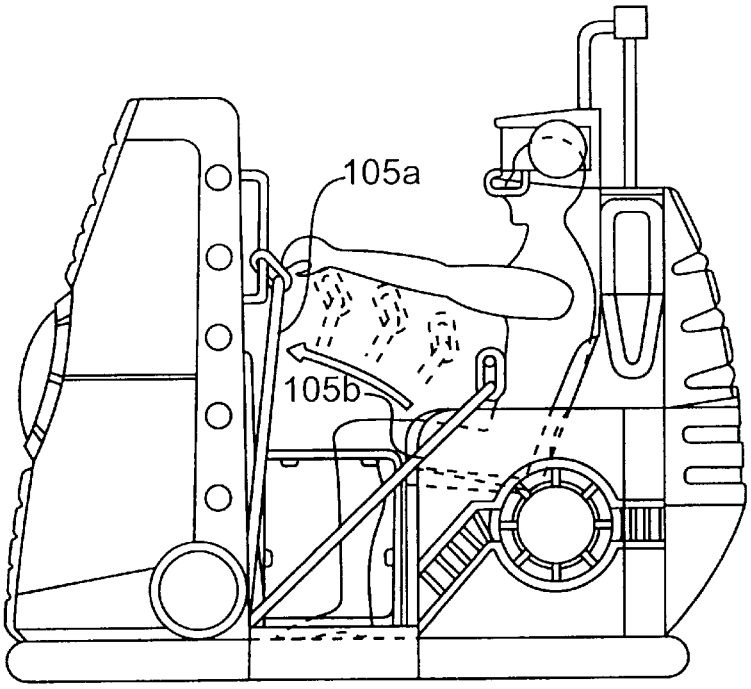
FIG. 21 is a diagram illustrating the car exit procedure (third step)
Figure 22:
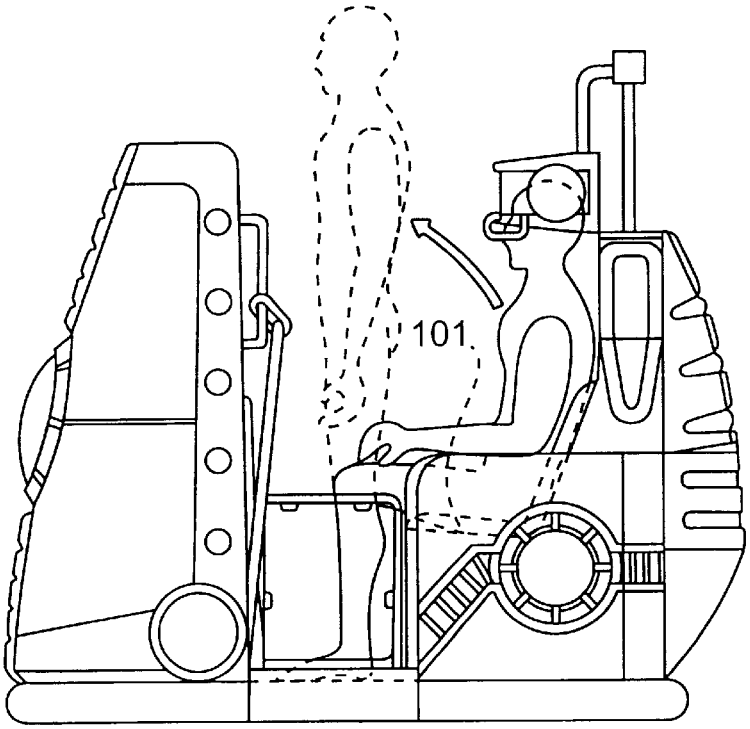
FIG. 22 is a diagram illustrating the car exit procedure (fourth step).

During player exit from the car 1, the operation is the opposite of the procedure for boarding the car, as illustrated in FIG. 19 through FIG. 22. Specifically, from the seated state depicted in FIG. 19, the player first pushes up the headrest 102, which has been unlocked (FIG. 20). Next, as shown in FIG. 21, the unlocked safety bar 105 is pushed back from the secured position 105*b* to the released position 105*a*. Next, the rider gets up from the seat 101, as shown in FIG. 22, and exits the car.

The car 1 from which the players have exited moves from the deboarding area 22 to the boarding area 21 along the guide 2, where it awaits boarding by the next players (S3–S5).

In accordance with the embodiment of the present invention described above, players are exposed to and scared by sudden sounds and images as they proceed down the passageway, and this can be expected to create a sense of unease. In the ride segment, the players are already in an uneasy state when boarding the car, and it may be expected that they will be extremely sensitive to any sort of stimulus. When riding in the car, players are given quite a shock by the mist spray, and are startled by blasts of air and vibration. The direction of mist spray from the headrest of one player sitting in a car has been adjusted such that the mist does not spray on the other player. Furthermore, the sound devices have been designed such that sound waves from other player's headrests are canceled. Thus, a player can become absorbed in game play without being distracted by unwanted sounds from other player's headrests.

By providing each player with sounds simulating the sound image of the adjacent player being attacked while delivering a mist spray from a discharge port location in the direction of the adjacent player, a player can be given the impression that the adjacent player is being attacked, and that a stream of blood is being spurted upon him or her, thereby intensifying the feeling of terror.

Where players riding this same ride happen to be couples, providing sound signals and disposing the discharge ports in the manner described above causes the couple to worry about each other, while greatly enhancing enjoyment of the game by the two as a result.

INDUSTRIAL APPLICABILITY

In accordance with the game machine which pertains to the present invention, players riding in the game machine are immobilized in a prescribed posture by posture immobilization devices. By immobilizing the posture of the players so that they cannot change their position freely, it becomes possible to provide individual players with various different stimuli. For example, by providing medium-discharge devices for discharging a medium onto a prescribed body region of players, the medium can be suddenly discharged onto a player during the course of the game, severely startling the player.

By providing forced air devices for blowing air on prescribed body regions, players can be startled by the air.

By providing vibration devices for subjecting players to vibration as the game proceeds, players can be startled by the vibration.

By immobilizing the head or other body part of a player and surrounding the head of the player, it becomes possible to dispose sound devices in such a way that sounds are delivered to the individual player in a noncontact fashion. Since the posture of the player is immobilized, the localization of the sound images perceived by the player does not change. In addition, the health problems and safety concerns associated with the use of headphones and other sound equipment are eliminated.

Where a plurality of players ride in the game machine at the same time, by orienting the discharge port for discharging the medium onto a prescribed bodily region of a player such that the medium is discharged in a direction other than the direction in which other players are sitting, the medium is not directed onto the other players when it is discharged onto the one player.

Where plurality of players are provided with sound devices, the phases are adjusted so as to produce a phase relationship between the phase of the sound waves produced by the sound device which delivers sound to the one of the players and the phase of the sound waves coming from the sound devices which deliver sound to the other players is an essentially inverse phase relationship. Thus, sound waves of sounds delivered to other players are canceled so that a player only hears those sounds specifically delivered to him or her. Accordingly, each player can become absorbed in game play without being distracted by sounds delivered to other players.

In addition, by disposing the sound broadcasting elements of the sound devices and broadcasting the sound images of the sounds broadcast by the sound broadcasting elements such that the sound images delivered to each player are perceived at symmetrical positions, it becomes possible in the case of a game program which involves the adjacent player being attacked by something, for example, to give each player the impression that the neighboring player is actually being attacked.

Where a plurality of game machines are to be operated simultaneously, by adjusting the sound devices such that sounds are broadcast simultaneously at equivalent time intervals by all of them, the players will not be distracted by sounds from other game machines and the realism of the game will not be diminished.

By disposing the medium-discharge devices such that the discharge positions with respect to the player of the medium discharged onto each player are symmetrical, it becomes possible in the case of a game program which involves the adjacent player being attacked by something, for example, to give a player the impression that the neighboring player is actually being attacked, and that a stream of blood is raining down on this player.

What is claimed is:

1. A game machine designed to be ridden by a player, comprising:

a posture immobilization device having a seat upon which the player sits and an upper abdomen pushing mechanism configured to selectively push an upper abdomen region of a seated player toward a backrest of the seat and immobilize the posture of the seated player's head within a limited range of possible motion relative to the backrest;

a medium-discharging device configured to discharge a prescribed medium onto a specific bodily region of the immobilized player; and wherein the pushing mechanism of the posture immobilization device limits the range within which the medium discharged from the medium-discharging device is aimed at the player by immobilizing the posture of the player's head within the limited range of motion to prevent the immobilized player from avoiding the prescribed medium discharged from the medium-discharging device.

2. A game machine as defined in claim 1, wherein the medium-discharging device comprises:

a pump for discharging a fixed quantity of the medium; and a nozzle for discharging the medium from the pump at a position corresponding to the cheek of the immobilized player.

3. A game machine as defined in claim 1 designed to be ridden by a plurality of players, wherein the medium-discharging device comprises a discharge portion configured for discharging the medium onto a specific facial body region of a selected one of the players and oriented such that the medium is directed toward a direction substantially away from a direction toward which other players are sitting.

4. A game machine as defined in claim 1, wherein the pushing mechanism immobilizes the player in the boarding position, and releases the player in the player deboarding position.

5. A game machine designed to be ridden by a player, comprising:

a posture immobilization device having a seat upon which the player sits and an upper abdomen pushing mechanism configured to selectively push an upper abdomen region of a seated player toward a backrest of the seat and immobilize the posture of the seated player's head within a limited range of possible motion relative to the backrest;

a forced air device configured to blow air onto the player; and wherein the pushing mechanism of the posture immobilization device limits the range over which the air blown from the forced air device contacts the player by immobilizing the posture of the player's head within the limited range of motion to prevent the immobilized player from avoiding the air blown from the forced air device.

6. A game machine as defined in claim 5, wherein the forced air device comprises:

a motor; and a fan for blowing air onto a location corresponding to the nape of the neck of the immobilized player.

7. A game machine as defined in claim 5, wherein the pushing mechanism immobilizes the player in the boarding position, and releases the player in the player deboarding position.

8. A game machine designed to be ridden by a player, comprising:

a posture immobilization device having a seat upon which the player sits and an upper body pushing mechanism configured to selectively push an upper abdomen region of a seated player toward a backrest of the seat and immobilize the posture of the seated player against the backrest;

a vibration delivery device configured to deliver vibration to the seated player; and wherein the biasing member of the posture immobilization device immobilizes a part of the player's upper body against a portion of the vibration delivery device by pushing the upper abdomen region of the seated player toward the backrest to prevent the immobilized player from avoiding the vibration delivered from the vibration delivery device.

9. A game machine as defined in claim 8, wherein the vibration delivery device comprises:

a motor;

a conversion mechanism for converting rotation of the motor into reciprocating motion; and a mechanism for transmitting the reciprocating motion converted by the conversion mechanism to the backrest of the immobilized player.

10. A game machine as defined in claim 8, wherein the pushing mechanism immobilizes the player in the boarding position, and releases the player in the player deboarding position.

11. A game machine designed to be ridden by a player, comprising:

a posture immobilization device having a seat upon which the player sits and a biased pushing mechanism configured to selectively push an upper abdomen region of a seated player toward a backrest of the seat and immobilize the posture of the seated player's head within a limited range of possible motion relative to the backrest;

a sound device configured to deliver sound to the player in a noncontact fashion; and wherein the biased pushing member of the posture immobilization device immobilizes a part of the player's upper body by pushing the upper abdomen region of the seated player toward the backrest, thereby limiting the range of possible motion of the player's head with respect to the sound device and preventing the immobilized player from avoiding the sound delivered from the sound device.

12. A game machine as defined in claim 11, wherein the pushing mechanism immobilizes the player in the boarding position, and releases the player in the player deboarding position.

13. A game machine as defined in claim 11 designed to be ridden by a plurality of players, wherein the sound device is configured to provide a first player with sounds simulating that a second player is being attacked.

14. The game machine as defined in claim 13 designed to be ridden by a plurality of players, wherein each of the sounds waves delivered to each of the players have substantially the same amplitude relative to each of the plurality of players.

15. A game machine as defined in claim 13 further comprising a second sound device configured to provide the second player with sounds simulating that the first player is being attacked.

16. The game machine as defined in claim 11 designed to be ridden by a plurality of players, wherein the sound device comprises a sequencer configured to deliver a first set of sound waves to a first seated player and to deliver a second set of sound waves to a second seated player such that the first seated player does not perceive the second set of sound waves and the second seated player does not perceive the first set of sound waves.

17. The game machine as defined in claim 11 designed to be ridden by a plurality of players, wherein the sound broadcasting elements comprises a sequencer configured to deliver a first set of sound waves to a first seated player and to deliver a second set of sound waves to a second seated player such that the first seated player does not perceive the second set of sound waves and the second seated player does not perceive the first set of sound waves.

18. A game machine as defined in claim 11, wherein the sound device includes first and second sound devices for providing the first player with sounds simulating that the second player is being attacked while providing the second player with sounds simulating that the first player is being attacked.

19. A game machine designed to be ridden by two players, comprising:

a plurality of sound devices for selectively delivering sound to each of the two players who are seated adjacently; and medium-discharging devices for discharging a prescribed medium onto a specific body region of each of the two players;

wherein the sound devices for delivering sound to each of the two players include symmetrical sound broadcasting elements thereof disposed in symmetrical fashion and are configured to deliver sound images of the sounds through the sound broadcast devices such that the sound images provided by each sound broadcasting element are perceived as being positioned symmetrically.

20. A game machine comprising:

a plurality of game machines as defined in claim 19;

where the sound devices of each game machine are adjusted such that sounds are broadcast simultaneously at equivalent time intervals.

21. A game machine designed to be ridden by two players, comprising:

a plurality of posture immobilization devices each having a seat upon a player sits and a biased pushing mechanism configured to selectively push an upper abdomen region of a seated player toward a backrest of the seat and immobilize the posture of each of the seated players' heads within limited ranges of possible motion relative to the backrest;

a plurality of sound devices for delivering sound to each of the two players who are seated adjacently;

a plurality of medium-discharging devices each having at least one discharge port for discharging a prescribed medium onto a specific body region of each of the two players;

wherein the discharge ports of the medium-discharging devices are disposed such that the positions of discharge onto the players of the medium which is discharged onto the players are symmetrical; and wherein the biased pushing member of the posture immobilization device limits the range within which the sound delivered by the sound devices and the medium discharged from the medium-discharging devices are directed at each of the seated players by immobilizing the posture of each of the seated players' heads within the limited ranges of motion to prevent the immobilized player from avoiding the sound delivered by the sound devices and the prescribed medium discharged from the medium-discharging device.

22. A game machine designed to be ridden by at least a first and a second player, comprising:

a first sound device for providing the first player with sounds indicating that the second player is being attacked;

a second sound device for providing the second player with sounds indicating that the first player is being attacked;

a first medium-discharging device for discharging a prescribed medium onto a specific body region of the first player;

a second medium-discharging device for discharging a prescribed medium onto a specific body region of the second player; and wherein the first and second sound devices and the first and second medium-discharging devices are configured to provide the first player with a first impression that the second player is being attacked, and the second player with a second impression that the first player is being attacked.

23. The game machine as defined in claim 22, wherein the first sound device provides sound to the first player while the second sound device provides sound to the second player.

24. The game machine as defined in claim 22, wherein the first medium-discharging device provides a discharge onto the first player while the second medium-discharging device provides a discharge onto the second player.

25. The game machine as defined in claim 22, wherein the first and second sound devices provide sound to the first and second players, respectively, while the first and second medium-discharging devices provides a discharge onto the first and second players, respectively.

26. A method of operating a riding game machine so as to immobilize a player riding the game machine comprising the steps of:

providing a posture immobilization device having a seat upon which the player sits and pushing mechanism configured to selectively push an upper abdomen region of a seated player toward a backrest of the seat and immobilize the posture of the seated player's head within a limited range of possible motion relative to the backrest;

providing a medium-discharging device configured to discharge a prescribed medium onto a specific bodily region of the immobilized player; and biasing the posture immobilization device so as to limit the range within which the medium discharged from the medium-discharging device is aimed at the player and prevent the immobilized player from avoiding the prescribed medium discharged from the medium-discharging device by immobilizing the posture of the player's head within the limited range of motion.

27. The method of claim 26, wherein the step of biasing the posture immobilization device includes the substep of immobilizing the player in a player boarding position and further comprising the step of unbiasing the posture immobilization device so as to release the player in a player deboarding position.

28. The method of claim 26, wherein the step of providing a medium-discharging device further including the substep of providing a discharge portion configured to discharge the medium onto a specific facial body region of a selected one of the players and oriented such that the medium is directed toward a direction substantially away from a direction toward which other players are sitting.

29. A method of operating a riding game machine designed to be ridden by a first player and a second player comprising the steps of:

providing the first player with sounds indicating that the second player is being attacked;

providing the second player with sounds indicating that the first player is being attacked;

providing a first medium-discharging device for discharging a prescribed medium onto a specific body region of the first player so as to provide the first player with a first impression that the second player is being attacked; and providing a second medium-discharging device for discharging a prescribed medium onto a specific body region of the second player so as to provide the second player with a second impression that the first player is being attacked.

30. A game machine designed to be ridden by a player, comprising:

a posture immobilization device having a seat upon which the player sits and an upper abdomen pushing mechanism biased against a seated player to selectively push an upper abdomen region of the seated player toward a backrest of the seat for immobilizing the posture of the seated player's head within a limited range of possible motion relative to the backrest;

a medium-discharging device for discharging a prescribed medium onto a specific bodily region of the immobilized player; and wherein the upper abdomen pushing mechanism of the posture immobilization device limits the range within which the medium discharged from the medium-discharging device is aimed at the player by immobilizing the posture of the player's head within the limited range of motion relative to the medium-discharging device so as to prevent the immobilized player from avoid the medium discharged from the medium-discharging device.

31. A game machine designed to be ridden by a player, comprising:

a posture immobilization device having a seat upon which the player sits and an upper body pushing mechanism having a biasing member selectively pushing an upper abdomen region of a seated player toward a backrest of the seat for immobilizing the posture of the seated player against the backrest;

a vibration delivery device having a vibrating back rest for subjecting the player to vibration; and wherein the biasing member of the posture immobilization device immobilizes a part of the player's upper body against a portion of the vibration delivery device by pushing the upper abdomen region of the seated player toward the backrest to prevent the immobilized player from avoiding the vibration of the vibrating back rest of the vibration delivery device.

32. A game machine designed to be ridden by at least one player, comprising:

a posture immobilization device having a seat upon which the player sits and a pushing mechanism including a biasing member selectively pushing an upper abdomen region of a seated player toward a backrest of the seat for immobilizing the posture of the seated player's head within a limited range of possible motion relative to the backrest;

a sound device having a symmetrical sound control device for delivering sound to the player in a noncontact fashion; and wherein the biasing member of the posture immobilization device immobilizes a part of the player's upper body by pushing the upper abdomen region of the seated player toward the backrest, thereby limiting the range of possible motion of the player's head with respect to the sound device and preventing the immobilized player from avoiding the sound delivered by the sound device.

33. A game machine designed to be ridden by a first player and a second player, comprising:

a plurality of sound devices for selectively delivering sound to the first player and the second player who is seated adjacent to the first player; and medium-discharging devices for discharging a prescribed medium onto a specific body region of each of the first and second players;

wherein the sound devices for delivering sound to each of the first and record players include sound broadcasting elements thereof disposed in symmetrical fashion and a symmetrical sound control device adjustably delivering sound images of the sounds through the sound broadcast devices such that the sound images provided by each sound broadcasting element are perceived as being positioned symmetrically.

34. A game machine as defined in claim 33, wherein the symmetrical sound control device provides the first player with sounds simulating that the second player is being attacked at a distance spaced away from the first player.

35. A game machine designed to be ridden by a first player and a second player, comprising:

a plurality of posture immobilization devices each having a seat upon which a player sits and a pushing mechanism including an upper body support member selectively pushing an upper abdomen region of a seated player toward a backrest of the seat for immobilizing the posture of each of the seated players' heads within limited ranges of possible motion relative to the backrest;

a plurality of sound devices for delivering sound to each of the first and second players who are seated adjacently;

a plurality of medium-discharging devices each having at least one discharge port for discharging a prescribed medium onto a specific body region of each of the first and second players;

wherein the discharge ports of the medium-discharging devices are disposed such that the prescribed medium is discharged onto the players at symmetrical locations; and wherein the upper body support member of the posture immobilization device limits the range within which the sound delivered by the sound devices and the medium discharged from the medium-discharging devices are directed at each of the first and second players by immobilizing the posture of first and second players' heads within the limited ranges of motion so as to prevent the immobilized players from avoiding the sound delivered by the sound devices and the prescribed medium discharged from the medium-discharging devices.

36. A game machine designed to be ridden by a player, comprising:

a posture immobilization device having a seat upon which the player sits and a pushing means for selectively pushing an upper abdomen region of a seated player toward a backrest of the seat and immobilizing the posture of the seated player's head within a limited range of possible motion relative to the backrest;

a discharge means for discharging a prescribed medium onto a specific bodily region of the immobilized player; and wherein the pushing means limits the range within which the medium discharged from the medium-discharging device is aimed at the player by immobilizing the posture of the player's head within the limited range of motion so as to prevent the immobilized player from avoiding the prescribed medium discharged from the discharge means.

37. A game machine designed to be ridden by a player, comprising:

a posture immobilization device having a seat upon which the player sits and a pushing means for selectively pushing an upper abdomen region of a seated player toward a backrest of the seat and immobilizing the posture of the seated player against the backrest;

a vibration means for delivering vibration to the seated player; and wherein the pushing means immobilizes a part of the player's upper body against a portion of the vibration delivery device by pushing the upper abdomen region of the seated player toward the backrest to prevent the immobilized player from avoiding the vibration delivered from the vibration delivery device.

38. A game machine designed to be ridden by a player, comprising:

a posture immobilization device having a seat upon which the player sits and a pushing means for selectively pushing an upper abdomen region of a seated player toward a backrest of the seat and immobilizing the posture of the seated player's head within a limited range of possible motion relative to the backrest;

a sound means for delivering sound to the player in a noncontact fashion; and wherein the pushing means immobilizes a part of the player's upper body by pushing the upper abdomen region of the seated player toward the backrest, thereby limiting the range of possible motion of the player's head with respect to the sound device and preventing the immobilized player from avoiding the sound delivered from the sound device.

39. A game machine designed to be ridden by a first player and a second player spaced from the first player, comprising:

means for providing the first player with sounds indicating that the second player is being attacked and for providing the second player with sounds indicating that the first player is being attacked;

means for providing a first medium-discharging device for discharging a prescribed medium onto a specific body region of the first player so as to provide the first player with a first impression that the second player is being attacked; and means for providing a second medium-discharging device for discharging a prescribed medium onto a specific body region of the second player so as to provide the second player with a second impression that the first player is being attacked.

* * * * *